US008826480B1

(12) United States Patent
Lyles

(10) Patent No.: US 8,826,480 B1
(45) Date of Patent: Sep. 9, 2014

(54) RESILIENT SHOE INSERT AND METHOD

(76) Inventor: Kelly Lyles, Aventura, FL (US)

( * ) Notice: Subject to any disclaimer, the term of this patent is extended or adjusted under 35 U.S.C. 154(b) by 528 days.

(21) Appl. No.: 13/075,431

(22) Filed: Mar. 30, 2011

Related U.S. Application Data

(60) Provisional application No. 61/318,875, filed on Mar. 30, 2010.

(51) Int. Cl.
*A43D 5/00* (2006.01)

(52) U.S. Cl.
USPC ..... 12/114.2; 12/114.6; 12/115.2

(58) Field of Classification Search
USPC ..... 12/114.2, 114.6, 115.2, 128 C
See application file for complete search history.

(56) References Cited

U.S. PATENT DOCUMENTS

| | | | | | |
|---|---|---|---|---|---|
| 189,418 | A | * | 4/1877 | Batley et al. | 12/114.6 |
| 241,102 | A | * | 5/1881 | Webb | 12/114.6 |
| 1,023,718 | A | * | 4/1912 | Busky | 12/141 |
| 1,107,037 | A | * | 8/1914 | Codling | 12/115.2 |
| 5,507,056 | A | * | 4/1996 | Brown | 12/114.2 |

* cited by examiner

*Primary Examiner* — Marie Bays
(74) *Attorney, Agent, or Firm* — H. John Rizvi; Gold & Rizvi P.A.

(57) ABSTRACT

A resilient shoe insert includes a generally V-shaped insert body having a pair of diverging insert segments; a plurality of indentations in each of the insert segments; and a plurality of frangible portions defined by the plurality of indentations, respectively.

14 Claims, 4 Drawing Sheets

RESILIENT SHOE INSERT AND METHOD

CROSS-REFERENCE TO RELATED APPLICATIONS

This application claims the benefit of U.S. provisional application No. 61/318,875, filed Mar. 30, 2010 and entitled SHOE RESILIENT INSERT, which provisional application is hereby incorporated by reference in its entirety.

BACKGROUND OF THE INVENTION

1. Field of the Invention

The present disclosure relates generally to shoe inserts. More particularly, the present disclosure relates to a resilient shoe insert and method in which a resilient shoe insert is used to maintain the shape and structural integrity of the pointed shoe tip portion of a pointed-tip shoe.

2. Description of the Prior Art

There exists a large variety of shoes for women including high heels, kitten heels, boots, wedge sandals, mules, slingbacks, espadrilles, pumps, etc. Some of these shoes may be very expensive, in which case the wearer may keep them for a long time. Some shoes such as high-heeled shoes and boots include a prominent tip that imparts an elongated and elegant appearance to the shoe.

A woman's dress-type shoe typically includes a sole including an insole and an outsole, a heel which can be high for fashion or to make the person look taller or can be flat for a more practical use, a vamp, a medial and a tip. If the tip of the shoe is pointed, as is typically the case in high heels and boots, then the toes of the wearer will not reach the end of the tip since the tip is narrower than the wearer's toes. Due to normal wear, the outer surface of the tip may become squashed or deteriorated, detracting from the general appearance of the shoe.

In order to prevent or reduce deterioration of the shoe, various shoe inserts which include homemade solutions have been devised. For example, a piece of cotton may be inserted in the shoe's tip in order to maintain its original, full appearance. The cotton functions as a cushion that maintains the original shape of the tip.

Also known is a woman's shoe insert which supports the inner portion of a shoe. An angled surface is formed at a rear end of the shoe insert and extends to a seat at a bottom end of the insert. The angled surface includes a locating trough having a broad top end and a narrow bottom end. The bottom end of the locating trough is engageable with a front end of a support rod, the rear end of which supports the rear end of the shoe. This type of insert is effective in maintaining the original shape of the shoe but can only be used when the shoe is not being worn.

Another solution to maintaining the shape of a shoe is a shoe insert which includes a sheet-like pad. The pad defines an upper surface and a lower surface and has a generally pointed shape for insertion into a front foot portion of footwear. The upper surface has an adhesive which secures the pad to an upper inner surface of the front foot portion of the footwear. The lower surface cushions the front foot portion to provide comfort to a person wearing the shoe. However, the shoe insert does not shape the shoe and merely provides comfort to the wearer of the shoe.

Also known is a two-piece tip protector which is to be worn on a shoe to protect the foot of a wearer. The tip protector includes a lower toe piece which is secured to the toe of the shoe, an upper covering piece which is located above the lower piece and extends rearwardly toward the ankle of the user and a cooperating attachment which protrudes from the top surface of the lower piece and the bottom surface of the upper piece to releasably hold the upper piece in a raised position above the bridge of the shoe with a clearance distance therebetween. The tip protector is placed on the outer surface of the shoe to protect the exterior surface of the tip portion of the shoe.

Even though the above-identified products address some of the needs of the market, a practical resilient shoe insert which is capable of being used while the shoe is worn and is also capable of being inserted and used in almost any type of pointed-tip shoe to maintain the general original appearance of the shoe is still desired.

SUMMARY OF THE INVENTION

The present disclosure is directed to a shoe insert and method which are especially designed to help maintain the original appearance of a pointed-tip shoe.

In one general aspect, the shoe insert may include a generally V-shaped plastic resilient piece that is inserted into the tip portion of a shoe.

Accordingly, it is a primary object of the present disclosure to provide a shoe insert which can be used while a user wears a shoe having a pointed tip without the shoe imparting discomfort to the user's toes.

Another aspect of the present disclosure provides an easy-to-manufacture, economical and practical solution for maintaining the outer portion of a shoe.

Yet another aspect of the present disclosure includes a shoe insert the length of which can be adjusted to fit into the tip of a shoe.

In summary, the present disclosure is generally directed to a resilient shoe insert which includes a resilient, generally V-shaped plastic piece including two straight linked segments or legs each of which includes several equally-spaced indentations along which the leg can be severed to adjust the length of each segment to the internal length of the shoe tip.

These and other aspects, features, and advantages of the present disclosure will become more readily apparent from the attached drawings and the detailed description of the illustrative embodiments, which follow.

BRIEF DESCRIPTION OF THE DRAWINGS

Various illustrative embodiments of the disclosure will hereinafter be described in conjunction with the appended drawings provided to illustrate and not to limit the invention, where like designations denote like elements, and in which.

DETAILED DESCRIPTION OF REPRESENTATIVE EMBODIMENTS

Figure 1:
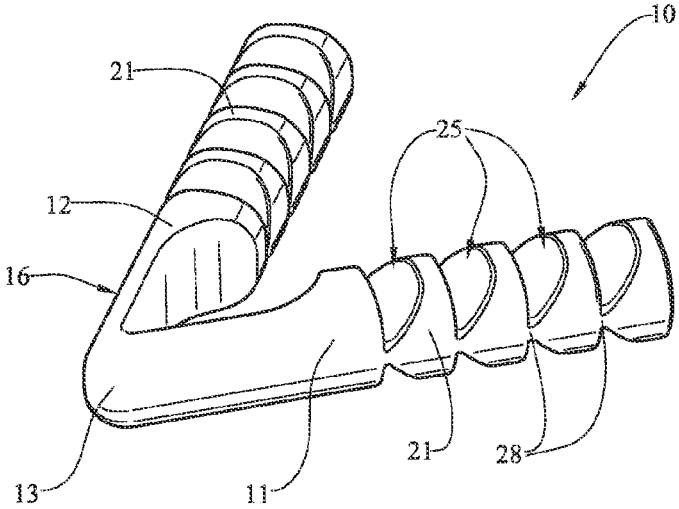
FIG. 1 is a general perspective view of an illustrative embodiment of the shoe insert accordance with the present disclosure.

Shown throughout the Figures, the disclosure is generally directed to a resilient shoe insert and method in which a resilient shoe insert is used to maintain the shape and structural integrity of the pointed shoe tip portion of a pointed-tip shoe. The resilient shoe insert may be applicable to maintaining the shape and structural integrity of the pointed tip portion of any of a variety of shoes including but not limited to women's pointed-tip dress shoes.

Referring initially to FIGS. 1-6 of the drawings, an illustrative embodiment of the shoe insert is generally indicated by reference numeral 10. The shoe insert 10 may include a generally V-shaped insert body 16 including a first insert segment 11 and a second insert segment 12. Each of the first insert segment 11 and the second insert segment 12 may be generally elongated and straight, diverging from each other and joined at an insert segment junction 13. In some embodiments, the insert body 16 may be a plastic material and the first insert segment 11 and the second insert segment 12 may be integral with the insert segment junction 13. The insert segment junction 13 may define a flexible hinge that allows the first insert segment 11 and the second insert segment 12 to deform as inward compression pressure is applied against the segments toward each other and recoil outwardly by memory to the original configuration upon release of the pressure, as will be hereinafter described.

Figure 2:
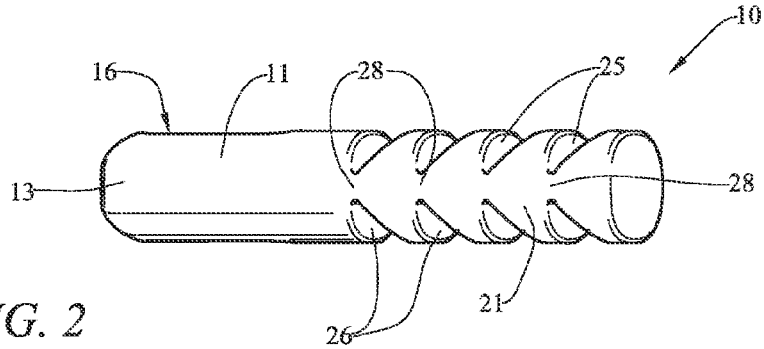
FIG. 2 is an elevational side view of an illustrative embodiment of the shoe insert, more particularly illustrating in detail the outer part of one of the legs or segments of the shoe insert.
Figure 3:
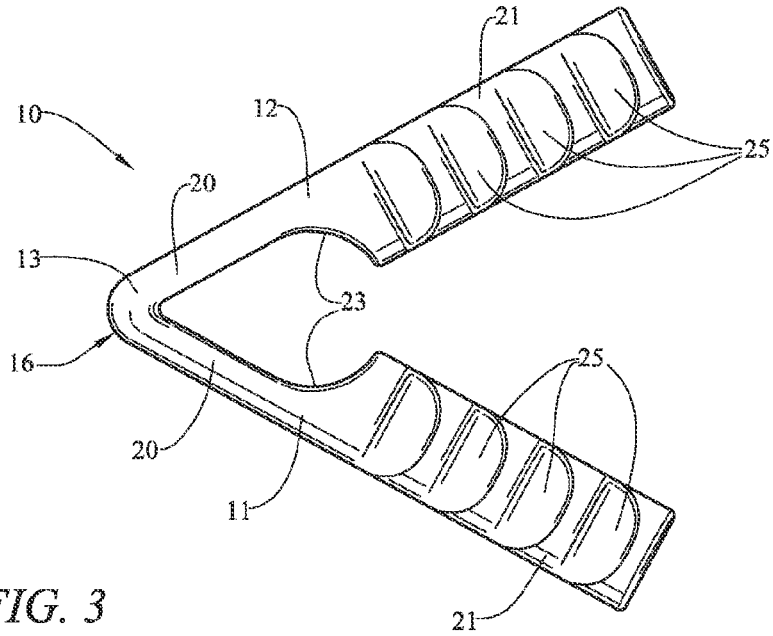
FIG. 3 is a top plan view of an illustrative embodiment of the shoe insert, more particularly illustrating the two legs or segments linked to form a V-shape piece and multiple indentations on the top of the distal section of each leg.
Figure 4:
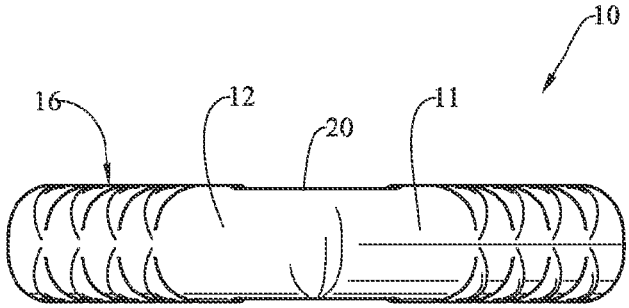
FIG. 4 is an elevational rear view of an illustrative embodiment of the shoe insert, more particularly illustrating the junction between the legs or segments.
Figure 5:
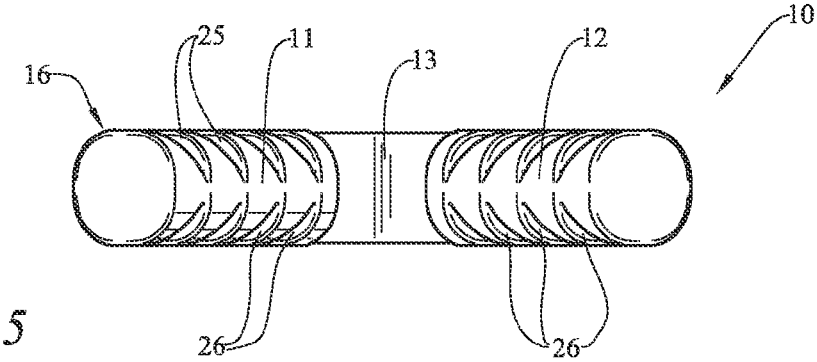
FIG. 5 is an elevational front view of an illustrative embodiment of the shoe insert.
Figure 6:
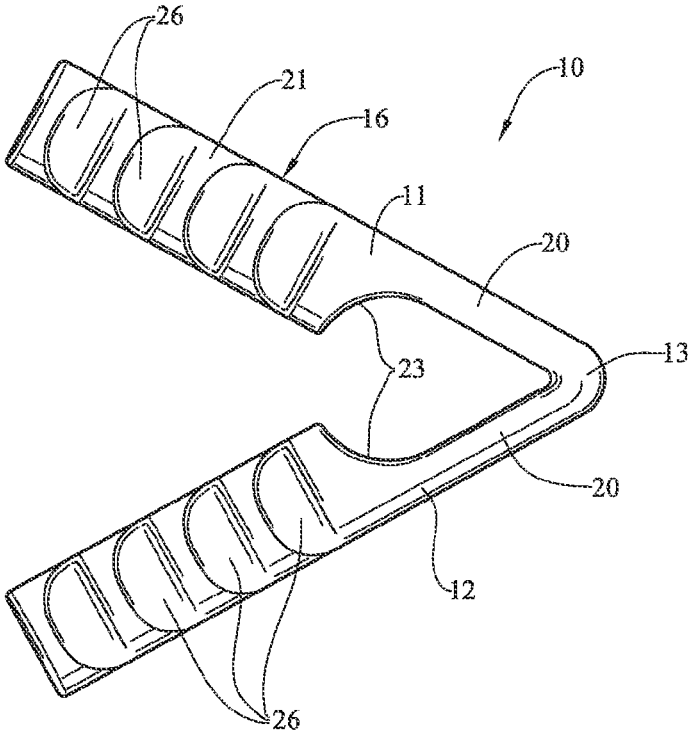
FIG. 6 is a bottom plan view of art illustrative embodiment of the shoe insert.

Each of the first insert segment 11 and the second insert segment 12 may include a generally elongated cylindrical portion 21. A flat section 20 may extend between the insert segment junction 13 and the cylindrical portion 21 of each of the first insert. segment 11 and the second insert segment 12. The diameter of the cylindrical portion 21 may be greater than the thickness of the flat section 20. Accordingly, a generally curved ramp-like portion 23 may extend between the flat section 20 and the cylindrical portion 21. As illustrated in FIG. 2, a first set of spaced-apart indentations 25 may be provided in a first surface of each of the first insert segment 11 and the second insert segment 12. A second set of spaced-apart indentations 26 may be provided in a second surface of each of the first insert segment 11 and the second insert segment 12. The second set of indentations 26 may be aligned with the first set of indentations 25; therefore, frangible portions 28 may be defined between the respective first set of indentations 25 and the second set of indentations 26. Accordingly, a selected length of each of the first insert segment 11 and the second insert segment 12 can be broken off at one of the frangible portions 28 according to the length of the first insert segment 11 and the second insert segment 12 which is necessary for use of the shoe insert 10, which will be hereinafter described.

Figure 7:
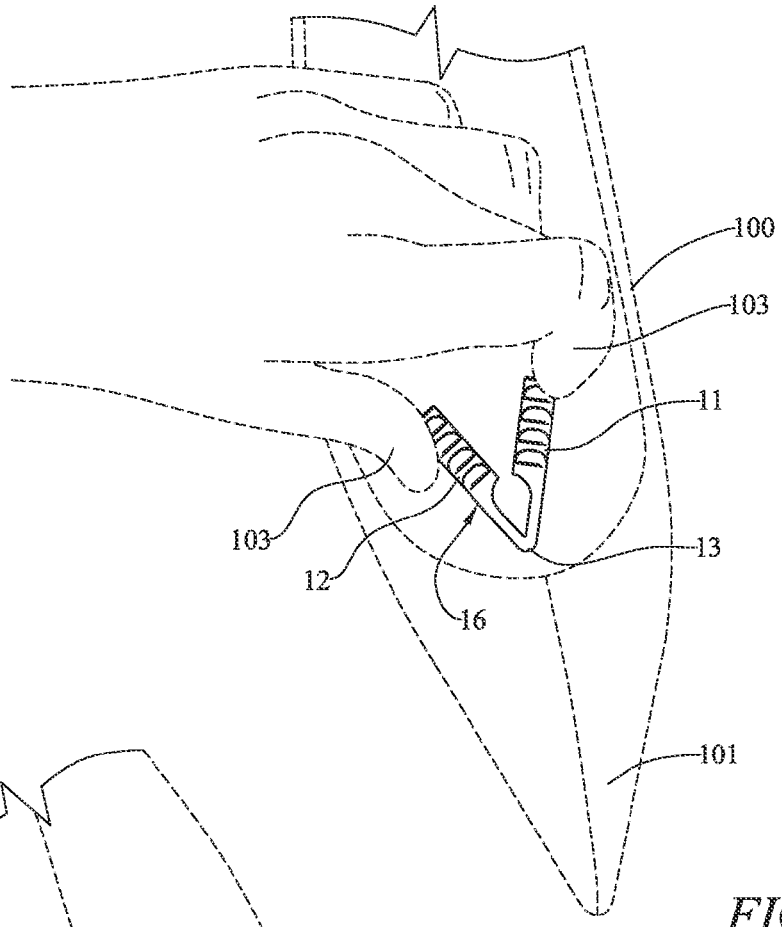
FIG. 7 is an schematic view illustrating exemplary placement of the shoe insert, in a pointed-tip shoe (in phantom).
Figure 8:
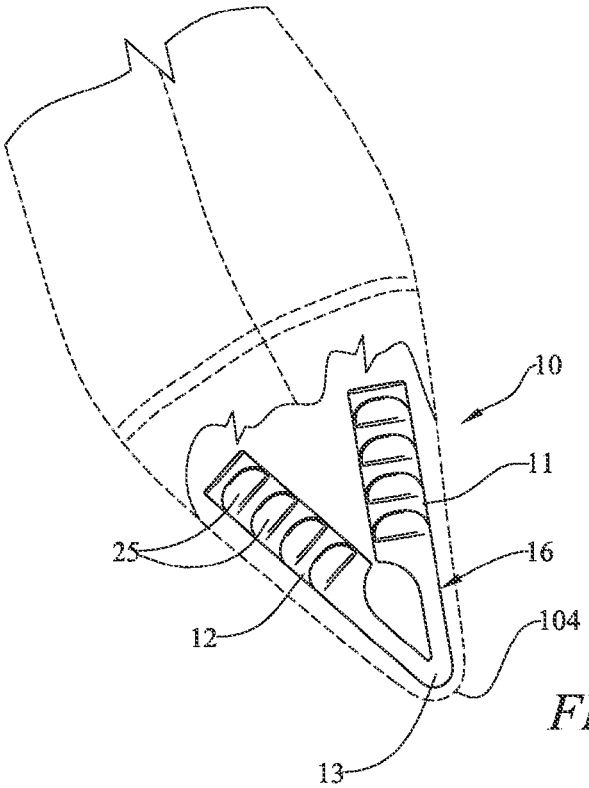
FIG. 8 is a schematic view illustrating the shoe insert in place in the pointed-tip shoe and pushing the walls of the shoe tip outwardly to maintain the general appearance of the shoe tip portion.

Referring next to FIGS. 7 and 8 of the drawings, in exemplary application, the shoe insert 10 is inserted into a pointed-tip shoe 100 to maintain the shape and structural integrity of the shoe tip 101 of the shoe 100. Accordingly, the first insert segment 11 and the second insert segment 12 are initially compressed toward each other at the insert segment junction 13 to compress the insert, body 16 typically by applying inward pressure using the fingers 103 to the first insert segment 11 and the second insert segment 12. The compressed shoe insert 10 is then inserted into the shoe 100 with the insert segment junction 13 of the insert body 16 initially facing toward the shoe tip 101 and then contacting the furthest inner point 104 of shoe tip 101, as illustrated in FIG. 8. The first insert segment 11 and the second insert segment 12 are then released such that the first insert segment 11 and the second insert segment 12 expand or recoil outwardly by elastic memory at the insert segment junction 13 and engage the inner surfaces of the respective sides of the shoe 100. Therefore, the outwardly-biased first insert segment 11 and second insert segment 12 maintain the original external shape and structural integrity of the shoe tip 101. It will be appreciated by those skilled in the art that the shoe insert 10 may remain in place in the shoe 100 as the shoe 100 is worn on the foot (not illustrated) of a wearer. Alternatively, the shoe insert 10 may be removed from the shoe 100 prior to wearing of the shoe 100. it will be further appreciated by those skilled in the art that the shoe insert 10 imparts additional weight to the shoe tip 101 of the shoe 100. This may prevent the shoe tip 101 from inadvertently lifting off the ground during walking as the shoe 100 is worn.

Depending on the configuration and length of the shoe tip 101 of the shoe 100, the user may be required to adapt the length of the first insert segment 11 and the second insert segment 12 accordingly. If the tip section 101 is shorter than the uncut length of the first insert segment 11 and the second insert segment 12, then the user may remove a portion of the first insert segment 11 and the second insert segment 12 to adapt them to the length of the shoe 100 into which the shoe insert 10 will be placed. To this end, the user may break off a segment of the first insert segment 11 and the second insert segment 12 by repeatedly bending the segment at the selected frangible portion 28 until the segment breaks off by fatigue from the remaining portion of the first insert segment 11 or second insert segment 12.

In the illustrative embodiments, the insert body 16 may be plastic although a variety of alternative materials including elastomeric materials, for example and without limitation, may be used for fabrication. Moreover, a variety of alternative shapes for the first insert segment 11, the second insert segment 12, the first set of indentations 25 and the second set of indentations 26 may be used. Also, while reference has been made herein to application of the shoe insert 10 to women's shoes, it will be recognized and appreciated by those skilled in the art that the shoe insert 10 may be equally applicable to men's shoes.

Figure 9:
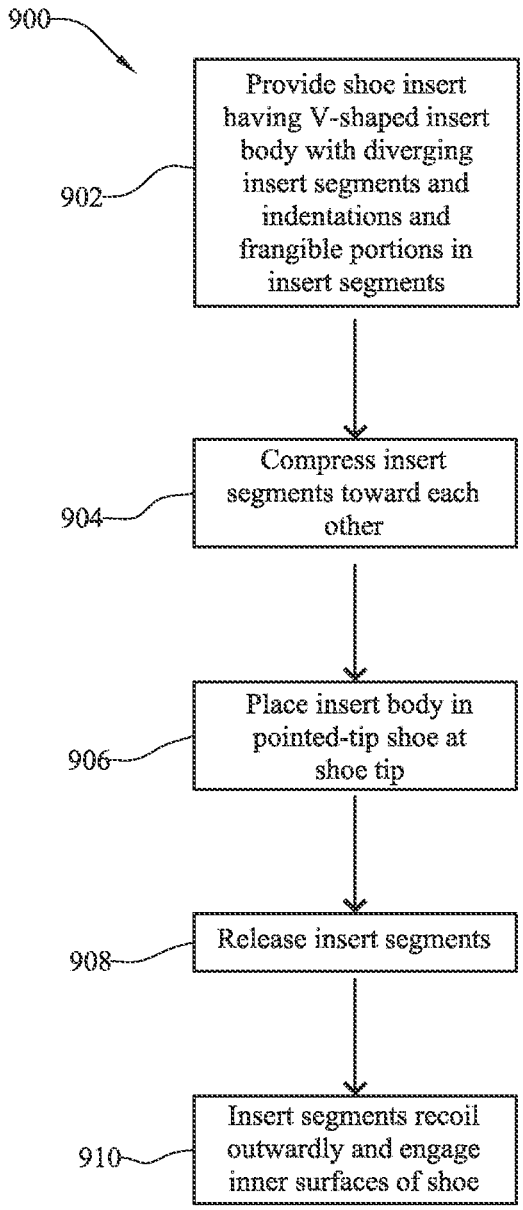
FIG. 9 is a flow diagram of an illustrative embodiment of a method of maintaining the shape and structural integrity of a pointed-tip shoe.

Referring next to FIG. 9 of the drawings, a flow diagram 900 which illustrates an illustrative embodiment of a method of maintaining the shape and structural integrity of a pointed-tip shoe is illustrated. In block 902, a resilient shoe insert having a generally V-shaped insert body with a pair of diverging insert segments and indentations and frangible portions in each of the insert segments is provided. In block 904, the insert segments of the insert body are compressed toward each other. In block 906, the compressed insert body is placed in a pointed-tip shoe at the shoe tip. In block 908, the insert segments are released. In block 910, the insert segments recoil outwardly and engage the respective inner surfaces of the shoe to maintain the structural integrity and shape of the pointed shoe tip.

While the preferred embodiments of the invention have been described above, it will be recognized and understood that various modifications can be made in the invention and the appended claims are intended to cover all such modifications which may fall within the spirit and scope of the invention.

I claim:

1. A resilient shoe insert, comprising:

a generally V-shaped insert body having a pair of diverging insert segments;

a plurality of indentations in each of the insert segments; and a plurality of frangible portions defined by the plurality of indentations, respectively.

2. The resilient shoe insert of claim 1 wherein the insert body comprises an elastomeric material.

3. The resilient shoe insert of claim 1 wherein the insert body comprises plastic.

4. The resilient shoe insert of claim 1 further comprising an insert segment junction and wherein the insert segments extend from the insert segment junction.

5. The resilient shoe insert of claim 1 wherein the plurality of indentations comprises a first set of indentations and a second set of indentations and wherein the frangible portions are defined by and between the first set of indentations and the second set of indentations, respectively.

6. The resilient shoe insert of claim 1 wherein each of the insert segments comprises a generally elongated cylindrical portion.

7. The resilient shoe insert of claim 6 further comprising an insert segment junction and wherein the insert segments extend from the insert segment junction and each of the insert segments comprises a flat section generally extending from the insert segment junction.

8. The resilient shoe insert of claim 7 further comprising a ramp-like portion extending between the flat section and the cylindrical portion.

9. A resilient shoe insert, comprising:

a generally V-shaped insert body having a pair of diverging insert segments;

a first set of spaced-apart indentations in a first surface of each of the insert segments;

a second set of spaced-apart indentations in a second surface of each of the insert segments; and a plurality of frangible portions defined by and between the first set of indentations and the second set of indentations.

10. The resilient shoe insert of claim 9 wherein the insert body comprises an elastomeric material.

11. The resilient shoe insert of claim 9 wherein the insert body comprises plastic.

12. The resilient shoe insert of claim 9 further comprising an insert segment junction and wherein the insert segments extend from the insert segment junction.

13. The resilient shoe insert of claim 9 further comprising an insert segment junction and wherein the insert segments extend from the insert segment junction and each of the insert segments comprises a flat section generally extending from the insert segment junction.

14. The resilient shoe insert of claim 13 further comprising a ramp-like portion extending between the flat segment and the cylindrical portion.

* * * * *